US009747867B2

(12) United States Patent
Lee et al.

(10) Patent No.: US 9,747,867 B2
(45) Date of Patent: Aug. 29, 2017

(54) APPARATUS AND METHOD FOR PERFORMING IMAGE CONTENT ADJUSTMENT ACCORDING TO VIEWING CONDITION RECOGNITION RESULT AND CONTENT CLASSIFICATION RESULT

(71) Applicant: MEDIATEK INC., Hsin-Chu (TW)

(72) Inventors: Wen-Fu Lee, Taichung (TW); Keh-Tsong Li, Kaohsiung (TW); Ying-Jui Chen, Hsinchu (TW); Ching-Sheng Chen, Taipei (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 14/608,201

(22) Filed: Jan. 29, 2015

(65) Prior Publication Data

US 2015/0356952 A1 Dec. 10, 2015

Related U.S. Application Data

(60) Provisional application No. 62/007,472, filed on Jun. 4, 2014.

(51) Int. Cl.

| | |
|---|---|
| ***G09G 5/10*** | (2006.01) |
| ***G09G 3/34*** | (2006.01) |
| *G09G 5/02* | (2006.01) |
| *G09G 5/00* | (2006.01) |

(52) U.S. Cl.

CPC ..... *G09G 5/10* (2013.01); *G09G 3/3406* (2013.01); *G09G 5/003* (2013.01); *G09G 5/02* (2013.01); *G09G 2320/0261* (2013.01); *G09G 2320/062* (2013.01); *G09G 2320/066* (2013.01); *G09G 2320/0613* (2013.01); *G09G 2320/0626* (2013.01); *G09G 2320/0666* (2013.01); *G09G 2320/08* (2013.01); *G09G 2360/144* (2013.01); *G09G 2360/16* (2013.01)

(58) Field of Classification Search

CPC ..... G09G 2360/144; H04N 1/00835; H04N 5/57; H04N 5/58

See application file for complete search history.

(56) References Cited

U.S. PATENT DOCUMENTS

2009/0087016 A1* 4/2009 Berestov ..... G06K 9/00664 382/100
2015/0070337 A1* 3/2015 Bell ..... G09G 3/2003 345/207

(Continued)

*Primary Examiner* — Antonio A Caschera
(74) *Attorney, Agent, or Firm* — Winston Hsu

(57) ABSTRACT

A display control apparatus includes a viewing condition recognition circuit, a content classification circuit, and a display adjustment circuit. The viewing condition recognition circuit recognizes a viewing condition associated with a display device to generate a viewing condition recognition result. The content classification circuit analyzes an input frame to generate a content classification result of contents included in the input frame. The display adjustment circuit generates an output frame by performing image content adjustment according to the viewing condition recognition result and the content classification result, wherein the image content adjustment comprises at least content-adaptive adjustment applied to at least a portion of pixel positions of the input frame based on the content classification result.

22 Claims, 16 Drawing Sheets

(56) References Cited

U.S. PATENT DOCUMENTS

2015/0102995 A1* 4/2015 Shen ..... G06F 3/013
345/156
2015/0242993 A1* 8/2015 Raman ..... G01V 8/12
345/589

* cited by examiner (A)

(B)

APPARATUS AND METHOD FOR PERFORMING IMAGE CONTENT ADJUSTMENT ACCORDING TO VIEWING CONDITION RECOGNITION RESULT AND CONTENT CLASSIFICATION RESULT

CROSS REFERENCE TO RELATED APPLICATIONS

This application claims the benefit of U.S. provisional application No. 62/007,472, filed on Jun. 4, 2014 and incorporated herein by reference.

BACKGROUND

The disclosed embodiments of the present invention relate to eye protection, and more particularly, to an apparatus and method for performing image content adjustment according to a viewing condition recognition result and a content classification result.

Many mobile devices are equipped with display capability (e.g., display screens) for showing information to the users. For example, a smartphone may be equipped a touch screen which can display information and receive a user input. However, when the viewing condition associated with a display screen becomes worse, a normal display output of the display screen may cause damages to user's eyes. Thus, there is a need for an eye protection mechanism which is capable of adjusting the display output to protect user's eyes from being damaged by an inappropriate display output provided under a worse viewing condition.

SUMMARY

In accordance with exemplary embodiments of the present invention, an apparatus and method for performing image content adjustment according to a viewing condition recognition result and a content classification result are proposed.

According to a first aspect of the present invention, an exemplary display control apparatus is disclosed. The exemplary display control apparatus includes a viewing condition recognition circuit, a content classification circuit, and a display adjustment circuit. The viewing condition recognition circuit is configured to recognize a viewing condition associated with a display device to generate a viewing condition recognition result. The content classification circuit is configured to analyze an input frame to generate a content classification result of contents included in the input frame. The display adjustment circuit is configured to generate an output frame by performing image content adjustment according to the viewing condition recognition result and the content classification result, wherein the image content adjustment comprises at least content-adaptive adjustment applied to at least a portion of pixel positions of the input frame based on the content classification result.

According to a second aspect of the present invention, an exemplary display control method is disclosed. The exemplary display control method includes: recognizing a viewing condition associated with a display device to generate a viewing condition recognition result; analyzing an input frame to generate a content classification result of contents included in the input frame; and utilizing a display adjustment circuit to generate an output frame by performing image content adjustment according to the viewing condition recognition result and the content classification result, wherein the image content adjustment comprises at least content-adaptive adjustment applied to at least a portion of pixel positions of the input frame based on the content classification result.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
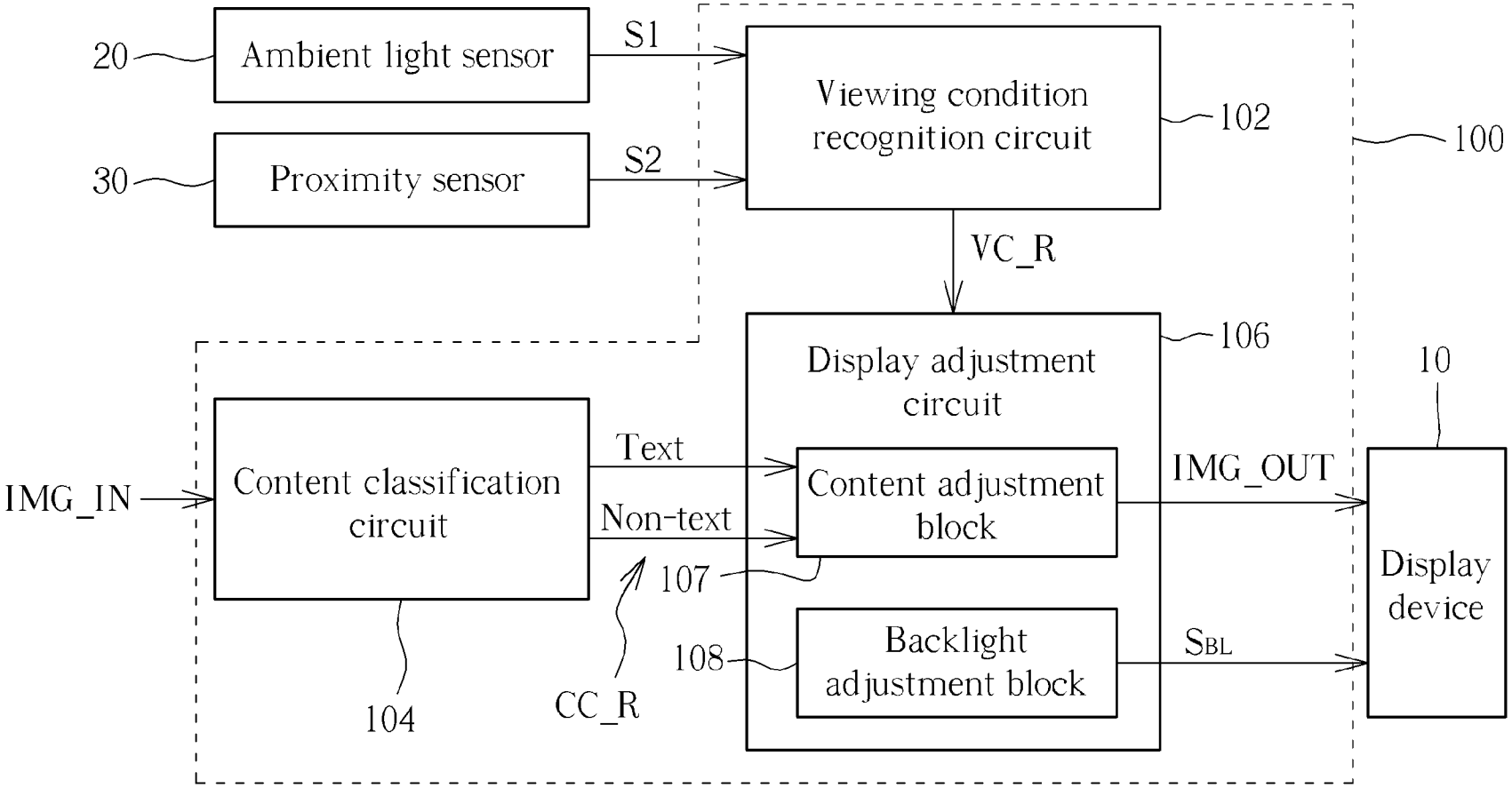
FIG. 1 is a block diagram illustrating a display control apparatus according to an embodiment of the present invention.

FIG. 1 is a block diagram illustrating a display control apparatus according to an embodiment of the present invention. By way of example, but not limitation, the display control apparatus 100 may be part of a mobile device, such as a mobile phone or a tablet. It should been noted that any electronic device using the proposed display control apparatus 100 to provide eye protection falls within the scope of the present invention. As shown in FIG. 1, the display control apparatus 100 includes a viewing condition recognition circuit 102, a content classification circuit 104, and a display adjustment circuit 106. The viewing condition recognition circuit 102 is coupled to at least the display adjustment circuit 106, and is configured to recognize a viewing condition associated with a display device 10 to generate a viewing condition recognition result VC_R to the display adjustment circuit 106. The viewing condition recognition result VC_R includes viewing condition information used to control operations of internal circuit blocks of the display adjustment circuit 106. Assuming that the display control apparatus 100 is implemented in an electronic device (e.g., a smartphone) equipped with an ambient light sensor 20 and/or a proximity sensor 30, the viewing condition recognition circuit 102 is further configured to receive at least one sensor output (e.g., a sensor output S1 of the ambient light sensor 20 and/or a sensor output S2 of the proximity sensor 30), and determine the viewing condition recognition result VC_R according to the at least one sensor output. It should be noted that the sensor output S1 is indicative of the ambient light intensity, and the sensor output S2 is indicative of the distance between the user and the electronic device (e.g., smartphone). In one exemplary design, the viewing condition recognition result VC_R may include uncomfortable viewing information (e.g., a confidence value $CV_{UV}$ of uncomfortable viewing) and ambient light intensity information (e.g., sensor output S1).

In a case where the sensor outputs S1 and S2 are both available, the viewing condition recognition circuit 102 may calculate the confidence value $CV_{UV}$ based on the following formula:

$$CV_{UV}=CV_{LL}\times CV_P \quad (1)$$

where $CV_{LL}$ represents a confidence value of low light, and $CV_P$ represents a confidence value of short distance. The confidence value $CV_{LL}$ may be calculated based on the sensor output S1, and the confidence value $CV_P$ may be calculated based on the sensor output S2. For example, the confidence value $CV_{LL}$ may be evaluated using the mapping function shown in sub-diagram (A) of FIG. 2, and the confidence value $CV_P$ may be evaluated using the mapping function shown in sub-diagram (B) of FIG. 2.

In another case where only one of the sensor outputs S1 and S2 is available, the viewing condition recognition circuit 102 may calculate the confidence value $CV_{UV}$ of uncomfortable viewing based on one of the following formulas.

$$CV_{UV}=CV_{LL} \quad (2)$$

$$CV_{UV}=CV_P \quad (3)$$

Figure 2:
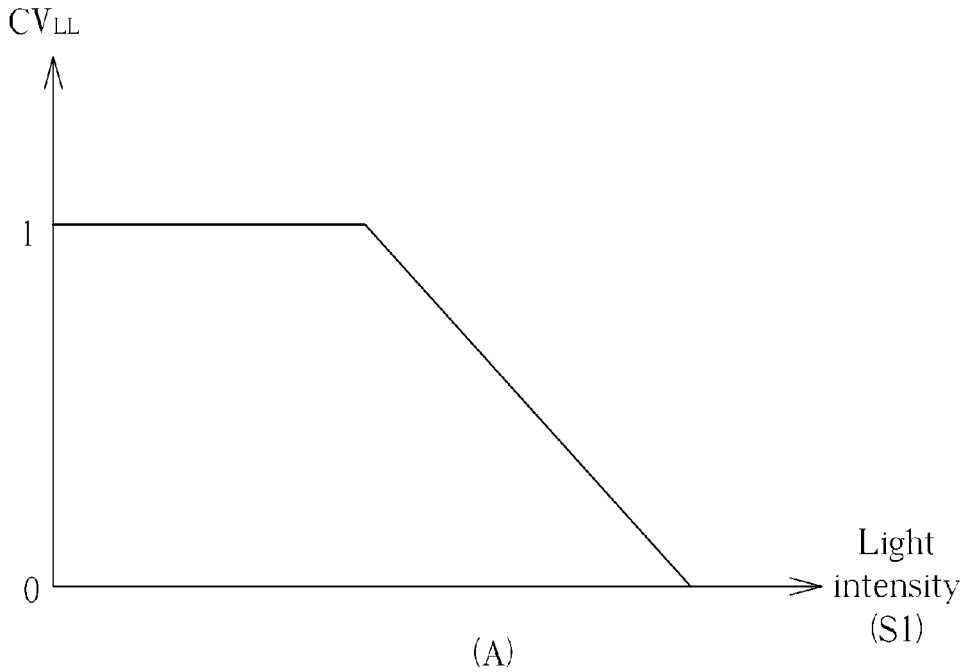
FIG. 2 is a diagram illustrating mapping functions used for determining a confidence value of low light and a confidence value of short distance according to an embodiment of the present invention.
Figure 2:
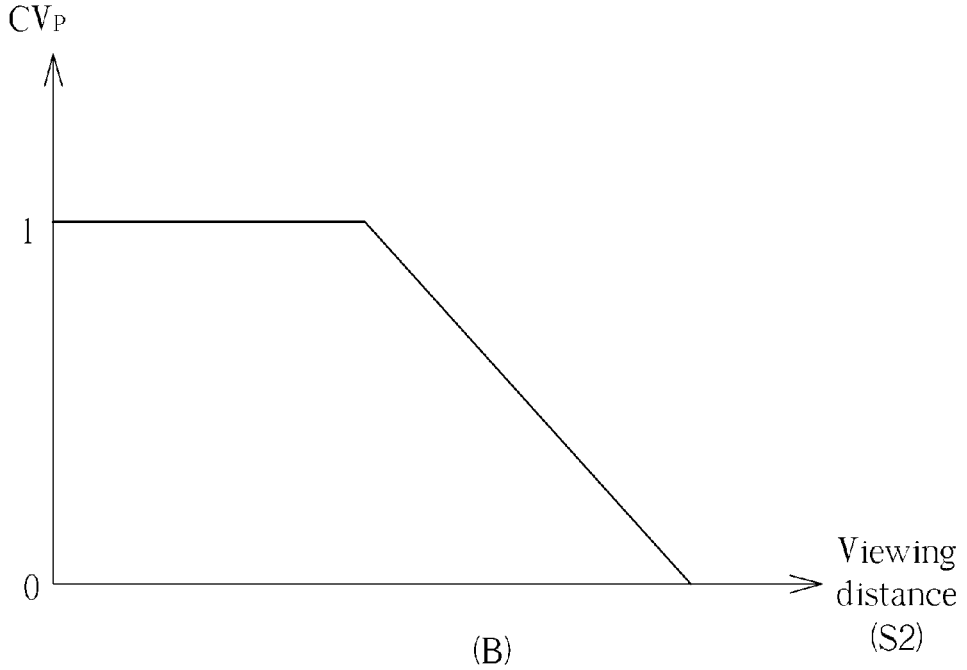

It should be noted that the mapping functions shown in FIG. 2 are for illustrative purposes only, and are not meant to be limitations of the present invention. In practice, the mapping functions may be adjusted, depending upon actual design consideration.

As can be seen from FIG. 2, a larger confidence value $CV_{UV}$ means a worse viewing condition for user's eyes. Hence, the display adjustment circuit 106 may refer to the confidence value $CV_{UV}$ to determine whether to activate the proposed display adjustment function, including image content adjustment and/or backlight adjustment. For example, the display adjustment circuit 106 is configured to compare the confidence value $CV_{UV}$ with a predetermined threshold $TH_1$ to control activation of a content adjustment block 107 and/or a backlight adjustment block 108. In this embodiment, the display adjustment circuit 106 activates the proposed display adjustment function when the confidence value $CV_{UV}$ is larger than the predetermined threshold $TH_1$ (i.e., $CV_{UV}>TH_1$).

The content classification circuit 104 is coupled to the display adjustment circuit 106, and is configured to analyze an input frame IMG_IN to generate a content classification result CC_R of contents included in the input frame IMG_IN. The input frame IMG_IN may be a single picture to be displayed on the display device 10, or one of successive video frames to be displayed on the display device 10. In this embodiment, the content classification circuit 104 is configured to extract edge information from the input frame IMG_IN to generate an edge map $MAP_{EG}$ of the input frame IMG_IN, and generate the content classification result CC_R according to the edge map $MAP_{EG}$.

Figure 3:
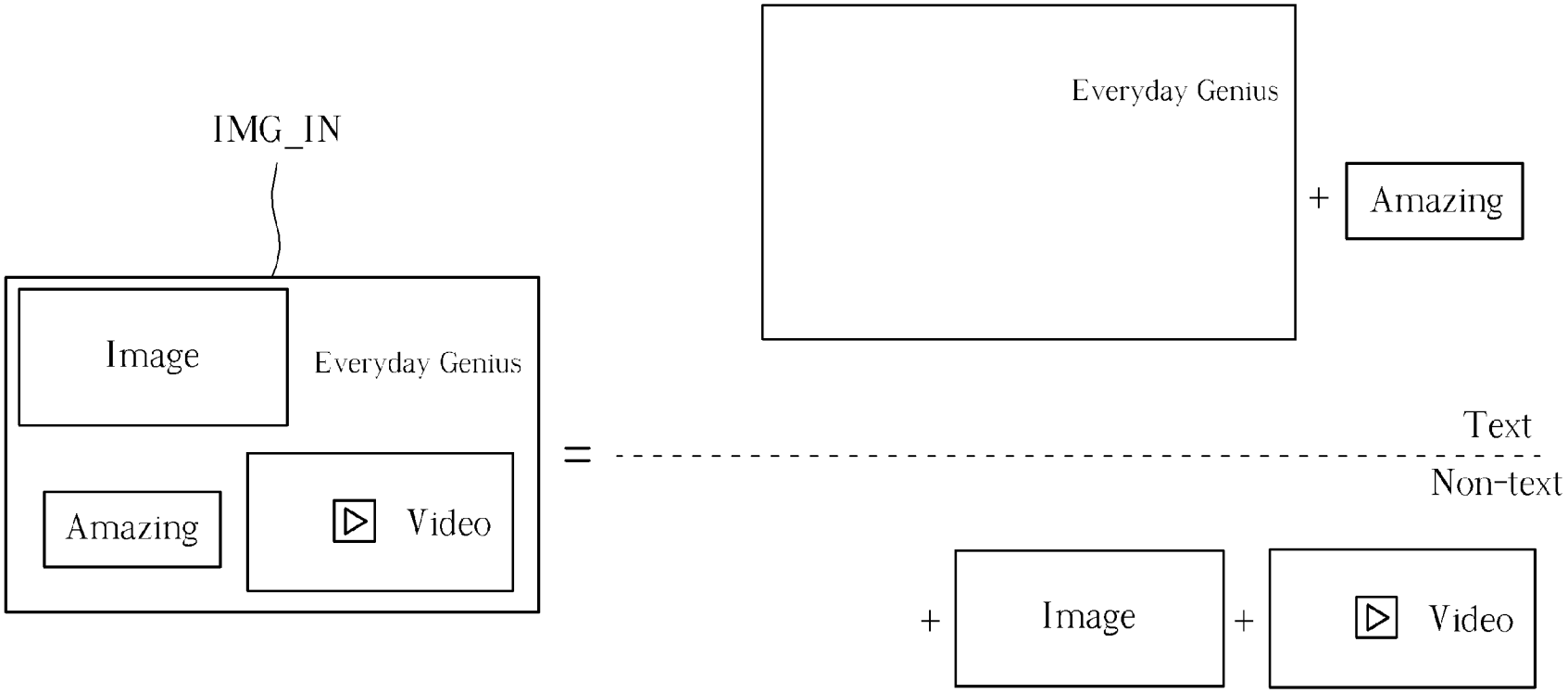
FIG. 3 is a diagram illustrating an example of an input frame fed into a content classification circuit shown in FIG. 1.

For example, the content classification circuit 104 is configured to generate the content classification result CC_R by classifying contents included in the input frame IMG_IN into text and non-text (e.g., image/video). FIG. 3 is a diagram illustrating an example of the input frame IMG_IN fed into the content classification circuit 104 shown in FIG. 1. In this example, the input frame IMG_IN is composed of text contents such as "Amazing" and "Everyday Genius" and non-text contents such as one still image and one video. After analyzing the input frame IMG_IN, the content classification circuit 104 is capable of identifying text contents and non-text contents from the input frame IMG_IN and outputting the content classification result CC_R to the display adjustment circuit 106 for further processing.

Figure 4:
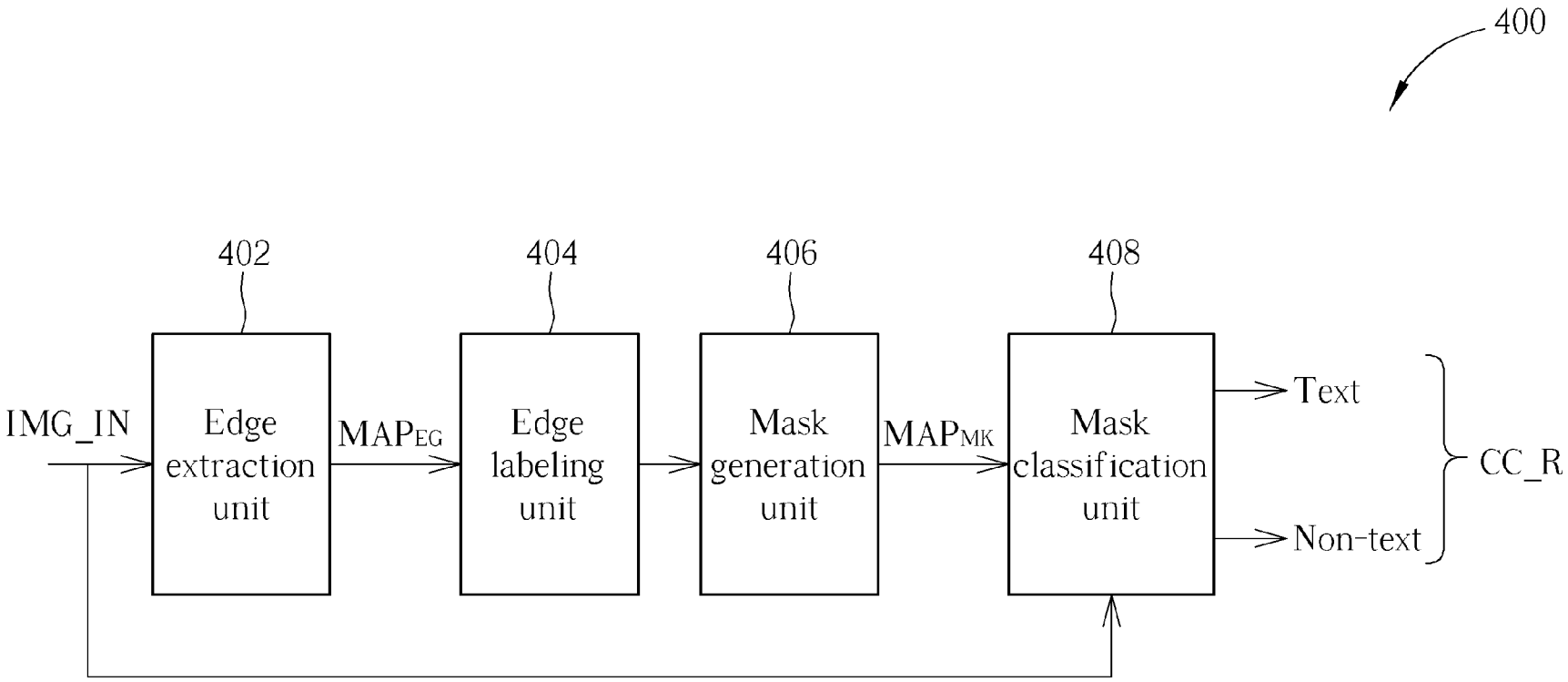
FIG. 4 is a block diagram illustrating a content classification circuit according to an embodiment of the present invention.

FIG. 4 is a block diagram illustrating a content classification circuit according to an embodiment of the present invention. The content classification circuit 104 shown in FIG. 1 may be implemented using the content classification circuit 400 shown in FIG. 4. The content classification circuit 400 includes an edge extraction unit 402, an edge labeling unit 404, a mask generation unit 406, and a mask classification unit 408. The edge extraction unit 402 is configured to extract edge information from the input frame IMG_IN to generate an edge map $MAP_{EG}$ of the input frame IMG_IN.

Figure 5:
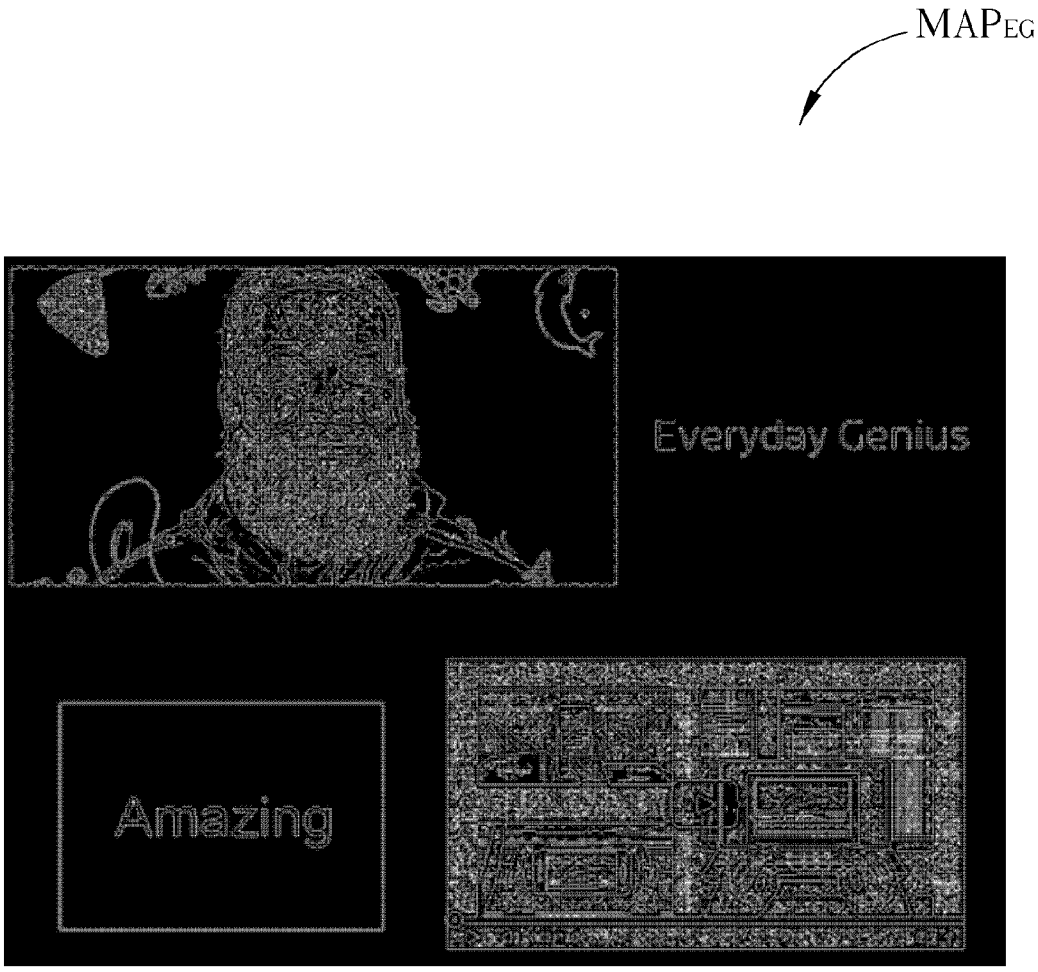
FIG. 5 is a diagram illustrating an example of an edge map generated from processing the input frame shown in FIG. 3.

FIG. 5 is a diagram illustrating an example of the edge map $MAP_{EG}$ generated from processing the input frame IMG_IN shown in FIG. 3. The edge map $MAP_{EG}$ may include edge values at all pixel positions of the input frame IMG_IN. It should be noted that the present invention has no limitations on the algorithm used for edge extraction. Any conventional edge filter capable of extracting edge information from the input frame IMG_IN may be employed by the edge extraction unit 402.

Figure 6:
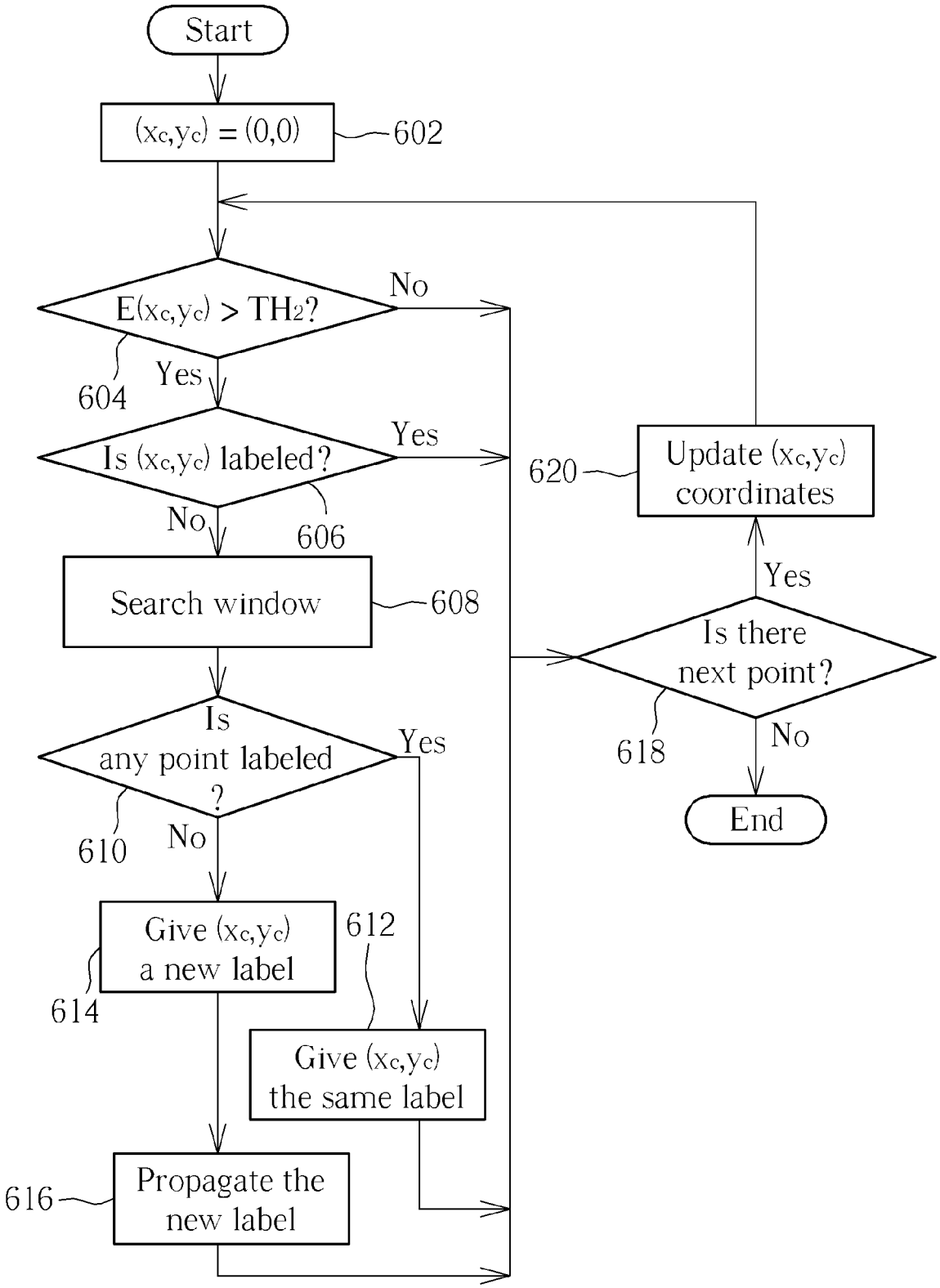
FIG. 6 is a flowchart illustrating an edge labeling method according to an embodiment of the present invention.

After the edge map $MAP_{EG}$ is created by the edge extraction circuit 402, the edge labeling unit 404 is operative to assign edge labels to at least a portion (i.e., part or all) of pixel positions of the input frame IMG_IN, i.e., at least a portion (i.e., part or all) of edge values in the edge map $MAP_{EG}$. FIG. 6 is a flowchart illustrating an edge labeling method according to an embodiment of the present invention. Provided that the result is substantially the same, the steps are not required to be executed in the exact order shown in FIG. 6. The edge labeling method may be employed by the edge labeling unit 404. In the beginning, a pixel position $(x_c, y_c)$ is selected for edge labeling (step 602). For example, the pixel position (0, 0) corresponding to a pixel located at the first row and first column of the input frame IMG_IN is selected as the initial pixel position $(x_c, y_c)$. It should be noted that the currently selected pixel position $(x_c, y_c)$ will be updated several times until all points within the edge map $MAP_{EG}$ have been checked (steps 618 and 620).

In step 604, the edge value E $(x_c, y_c)$ at the currently selected pixel position $(x_c, y_c)$ is compared with a predetermined threshold $TH_2$. The predetermined threshold $TH_2$ is used to filter out noise, i.e., small edge values. Hence, when the edge value E $(x_c, y_c)$ is not larger than the predetermined threshold $TH_2$, the following edge labeling steps performed for the currently selected pixel position $(x_c, y_c)$ are skipped. When the edge value E $(x_c, y_c)$ is larger than the predetermined threshold $TH_2$, the edge labeling flow proceeds with step 606. Step 606 is performed to check if the currently selected pixel position $(x_c, y_c)$ is already assigned with an edge label. When an edge label has been assigned to the currently selected pixel position $(x_c, y_c)$, the following edge labeling steps performed for the currently selected pixel position $(x_c, y_c)$ are skipped. When there is no edge label assigned to the currently selected pixel position $(x_c, y_c)$ yet, the edge labeling flow proceeds with step 608.

Figure 7:
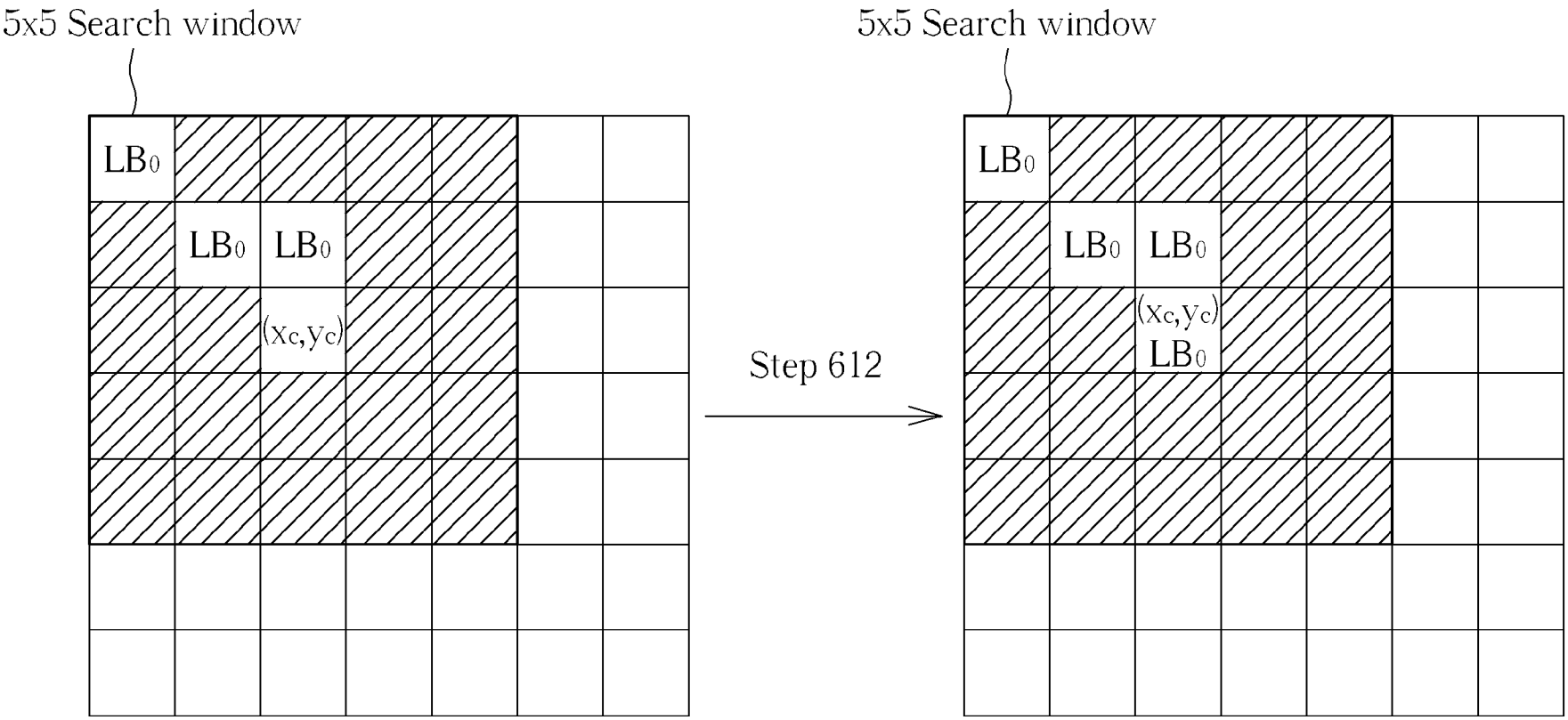
FIG. 7 is a diagram illustrating an operation of assigning an existing edge label found in a search window to a currently selected pixel position according to an embodiment of the present invention.

In step 608, a search window is defined to have a center located at the currently selected pixel position $(x_c, y_c)$. For example, a 5×5 block may be used to act as one search window. Next, step 610 is performed to check if there is any point within the search window that is already assigned with an edge label. When an edge label has been assigned to point (s) within the search window, the currently selected pixel position $(x_c, y_c)$ (i.e., a center position of the search window) is assigned with an existing edge label found in the search window. FIG. 7 is a diagram illustrating an operation of assigning an existing edge label found in the search window to the currently selected pixel position according to an embodiment of the present invention. Concerning a 5×5 search window centered at the currently selected pixel position $(x_c, y_c)$, there are points assigned with the same edge label $LB_0$. Hence, step 612 is performed to directly assign the same edge label $LB_0$ to the currently selected pixel position $(x_c, y_c)$. Next, the edge labeling flow proceeds with step 618 to check if there is any point in the edge map $MAP_{EG}$ that is not checked yet. When the edge map $MAP_{EG}$ still has point (s) waiting for edge labeling, the currently selected pixel position $(x_c, y_c)$ will be updated by a pixel position of the next point (steps 618 and 620).

Figure 8:
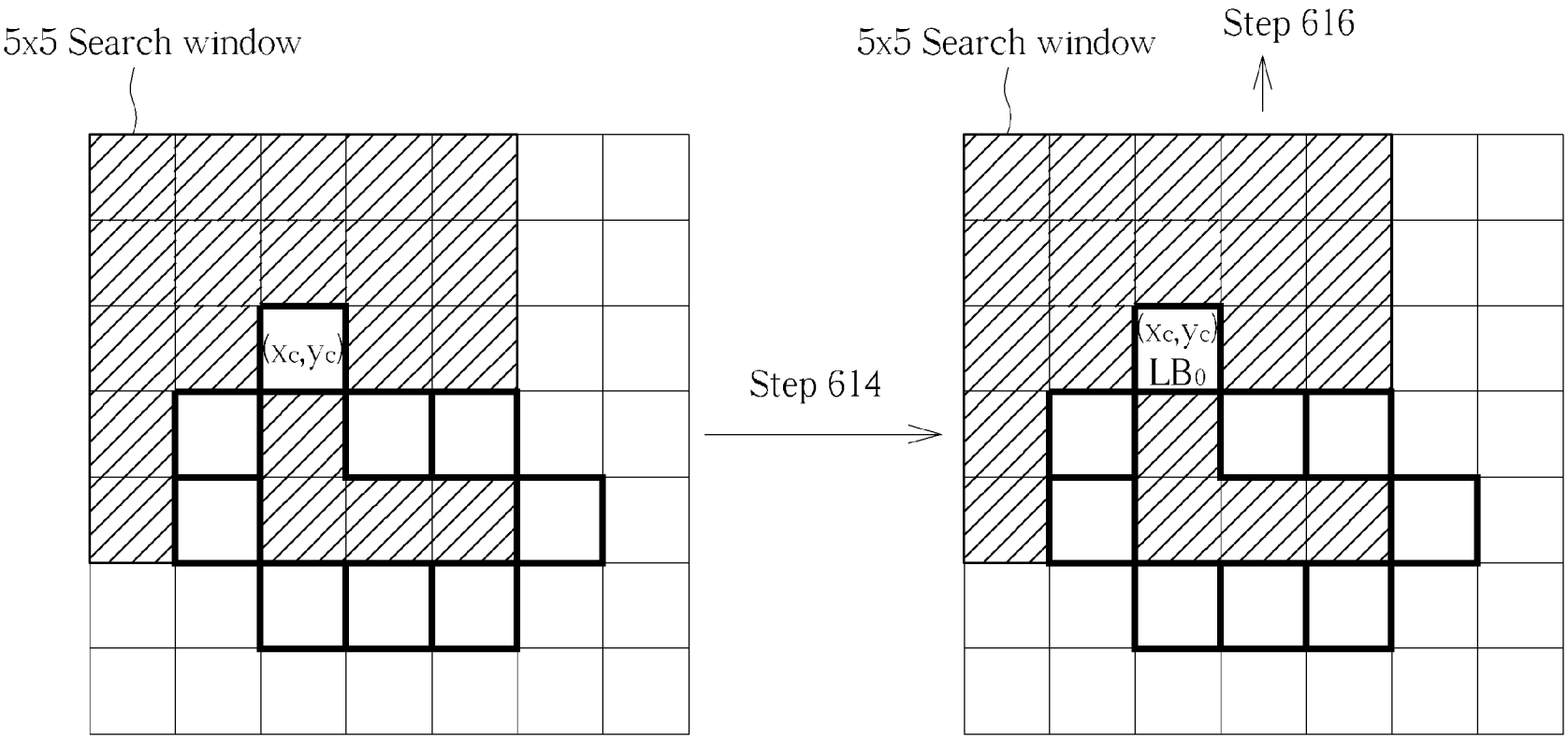
FIG. 8 is a diagram illustrating an operation of assigning a new edge label to a currently selected pixel position according to an embodiment of the present invention.

When step 610 decides that none of the points within the search window has an edge label already assigned thereto, a new edge label that is not used before is assigned to the currently selected pixel position $(x_c, y_c)$ (i.e., center position of the search window). FIG. 8 is a diagram illustrating an operation of assigning a new edge label to the currently selected pixel position according to an embodiment of the present invention. In the 5×5 search window centered at the currently selected pixel position $(x_c, y_c)$, no point is assigned with an edge label. Hence, step 614 is performed to assign a new edge label $LB_0$ to the currently selected pixel position $(x_c, y_c)$. Next, the edge labeling flow proceeds with step 616 to propagate the new edge label $LB_0$ set in step 614.

Figure 9:
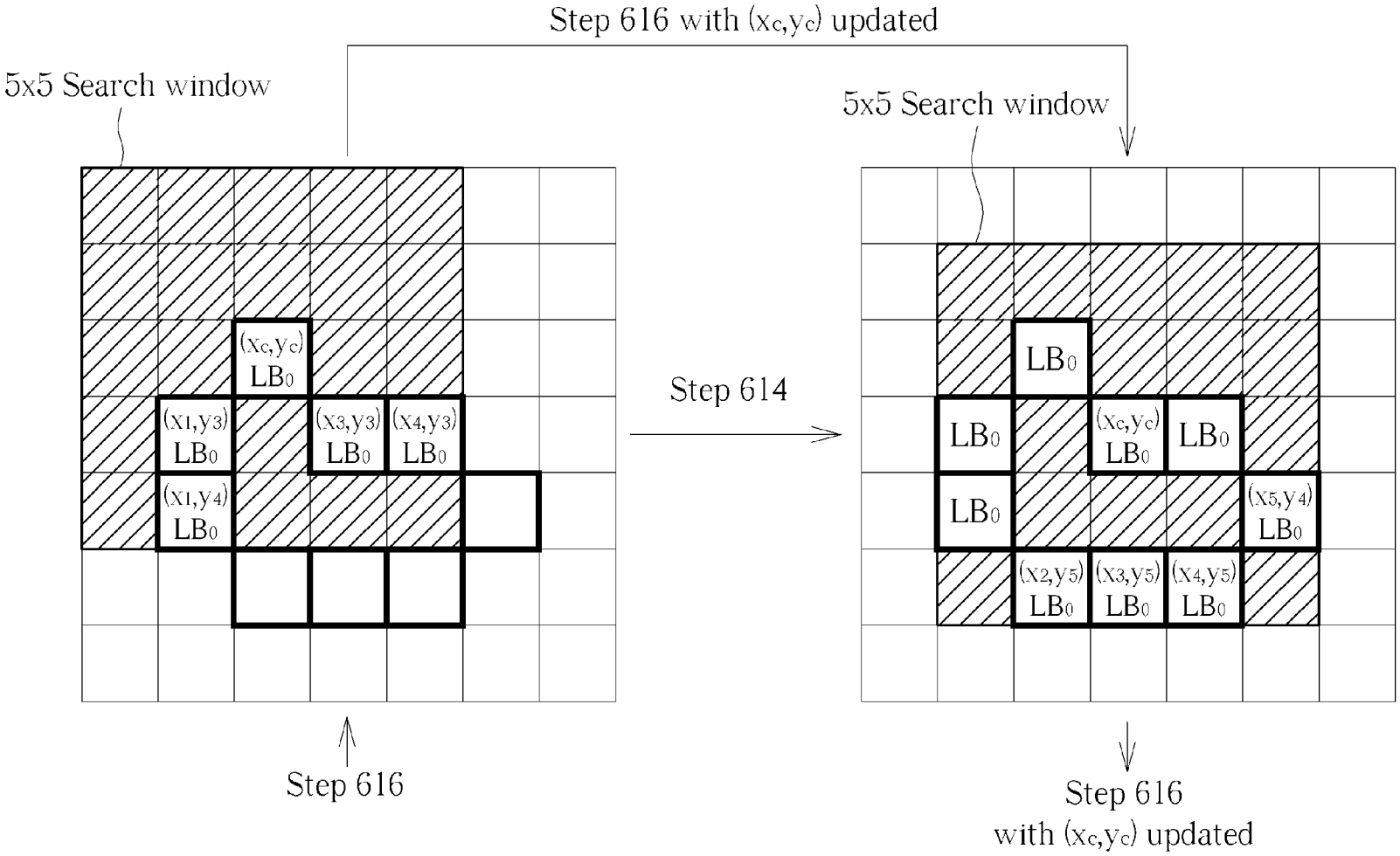
FIG. 9 is a diagram illustrating an operation of propagating an edge label from a current pixel position to nearby pixel positions according to an embodiment of the present invention.

When a current pixel is at an edge of an object within the input frame IMG_IN, nearby pixels are likely to be at the same edge. Based on such an observation, an edge label propagation procedure is performed in step 616 to assign the same edge label defined in step 614 to one or more nearby points each having no edge label assigned thereto yet. Please refer to FIG. 8 in conjunction with FIG. 9. FIG. 9 is a diagram illustrating an operation of propagating an edge label from a current pixel position to nearby pixel positions according to an embodiment of the present invention. As mentioned above, step 614 assigns the new edge label $LB_0$ to the currently selected pixel position $(x_c, y_c)$. In this embodiment, step 616 may check edge values at other pixel positions within the search window centered at the currently selected pixel position $(x_c, y_c)$, identify specific edge value (s) larger than the predetermined threshold $TH_2$, and assign the same edge label $LB_0$ to pixel position (s) corresponding to identified specific edge value (s). As shown in the left part of FIG. 9, the same edge label $LB_0$ is propagated from the pixel position $(x_c, y_c)$ to four nearby pixel positions $(x_1, y_3)$, $(x_1, y_4)$, $(x_3, y_3)$, $(x_4, y_3)$. Since each of newly discovered pixel positions $(x_1, y_3)/(x_1, y_4)$, $(x_3, y_3)$, $(x_4, y_3)$ is not checked before (i.e., not selected by step 620 before), step 616 will update the currently selected pixel position $(x_c, y_c)$ by each of the newly discovered pixel positions $(x_1, y_3)$, $(x_1, y_4)$, $(x_3, y_3)$, $(x_4, y_3)$, thereby moving the 5×5 search window to different center positions $(x_1, y_3)$, $(x_1, y_4)$, $(x_3, y_3)$, $(x_4, y_3)$ for finding additional nearby pixel positions that can be assigned with the same edge label $LB_0$ set in step 614.

For example, the currently selected pixel position $(x_c, y_c)$ is updated to $(x_3, y_3)$. Similarly, step 616 may check edge values at other pixel positions within the updated search window centered at the currently selected pixel position $(x_c, y_c)$, identify specific edge value (s) larger than the predetermined threshold $TH_2$, and assign the same edge label $LB_0$ to pixel position (s) corresponding to identified specific edge value (s). As shown in the right part of FIG. 9, the same edge label $LB_0$ is further propagated to four nearby pixel positions $(x_2, y_5)$, $(x_3, y_5)$, $(x_4, y_5)$, $(x_5, y_4)$.

It should be noted that the edge label propagation procedure is not terminated unless all of the newly discovered pixel positions (i.e., nearby pixel positions assigned with the same propagated edge label) have been used to update the currently selected pixel position $(x_c, y_c)$ and no further nearby pixel positions can be assigned with the propagated edge label.

After each edge value larger than the predetermined threshold $TH_2$ is assigned with an edge label, the edge labeling flow is finished. Based on the edge labeling result, the mask generation unit 406 generates one mask for each edge label. For example, concerning pixel positions assigned with the same edge label, the mask generation unit 406 finds four coordinates, including the leftmost coordinate (i.e., X-axis coordinate of leftmost pixel position), the rightmost coordinate (i.e., X-axis coordinate of rightmost pixel position), the uppermost coordinate (i.e., Y-axis coordinate of uppermost pixel position) and the lowermost coordinate (i.e., Y-axis coordinate of lowermost pixel position), to determine one corresponding mask.

Figure 10:
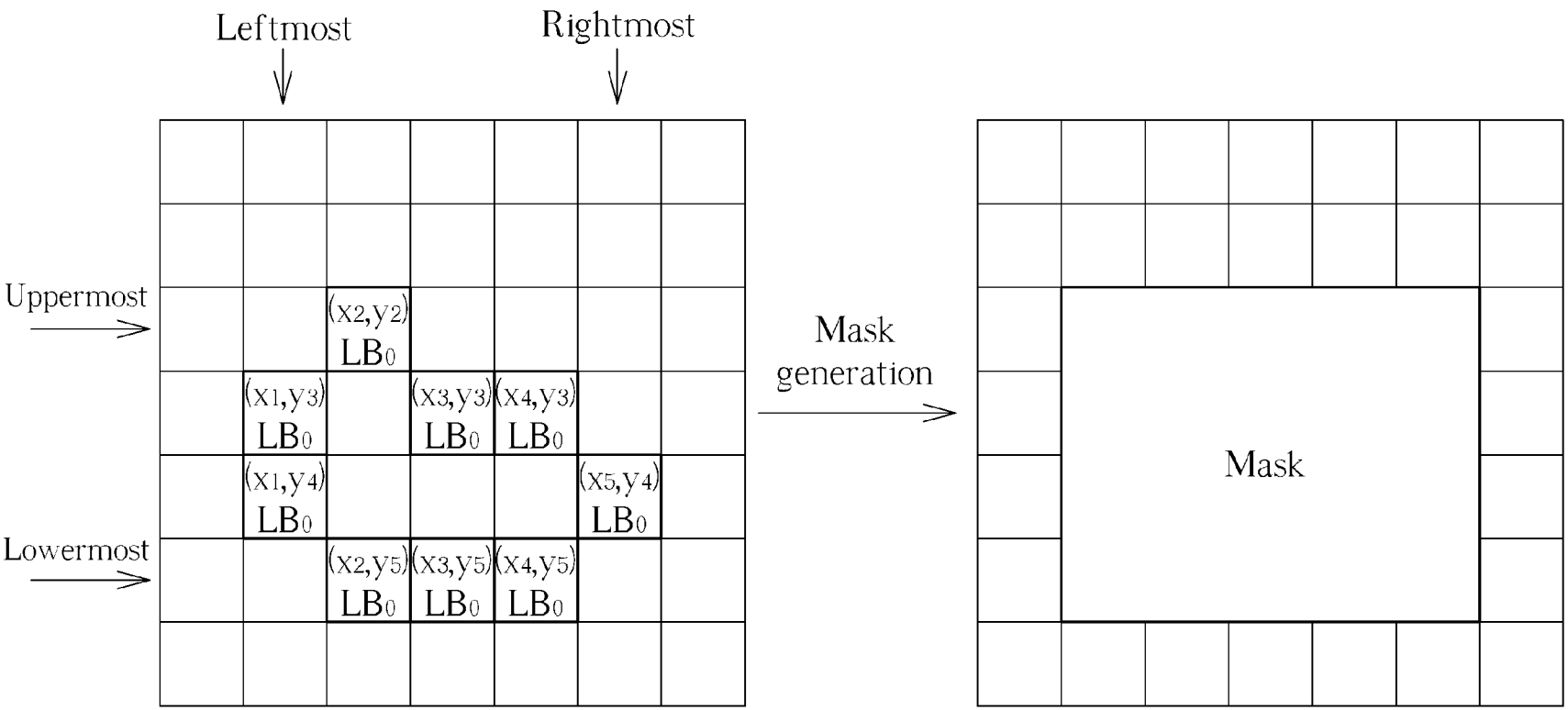
FIG. 10 is a diagram illustrating an operation of generating a mask for an edge label according to an embodiment of the present invention.

FIG. 10 is a diagram illustrating an operation of generating a mask for an edge label according to an embodiment of the present invention. As can be seen from FIG. 10, the same edge label $LB_0$ is assigned to several pixel positions $(x_2, y_2)$, $(x_1, y_3)$, $(x_3, y_3)$, $(x_4, y_3)$, $(x_1, y_4)$, $(x_5, y_4)$, $(x_2, y_5)$, $(x_3, y_5)$ and $(x_4, y_5)$. Hence, among the pixel positions assigned with the same edge label $LB_0$, the leftmost coordinate is $x_1$, the rightmost coordinate is $x_5$, the uppermost coordinate is $y_2$, and the lowermost coordinate is $y_5$. Hence, a rectangular area defined by these coordinates $(x_1, x_5, y_2, y_5)$ is defined as a mask for the edge label $LB_0$. After masks of all edge labels are determined, a mask map $MAP_{MK}$ is generated by the mask generation unit 406.

Figure 11:
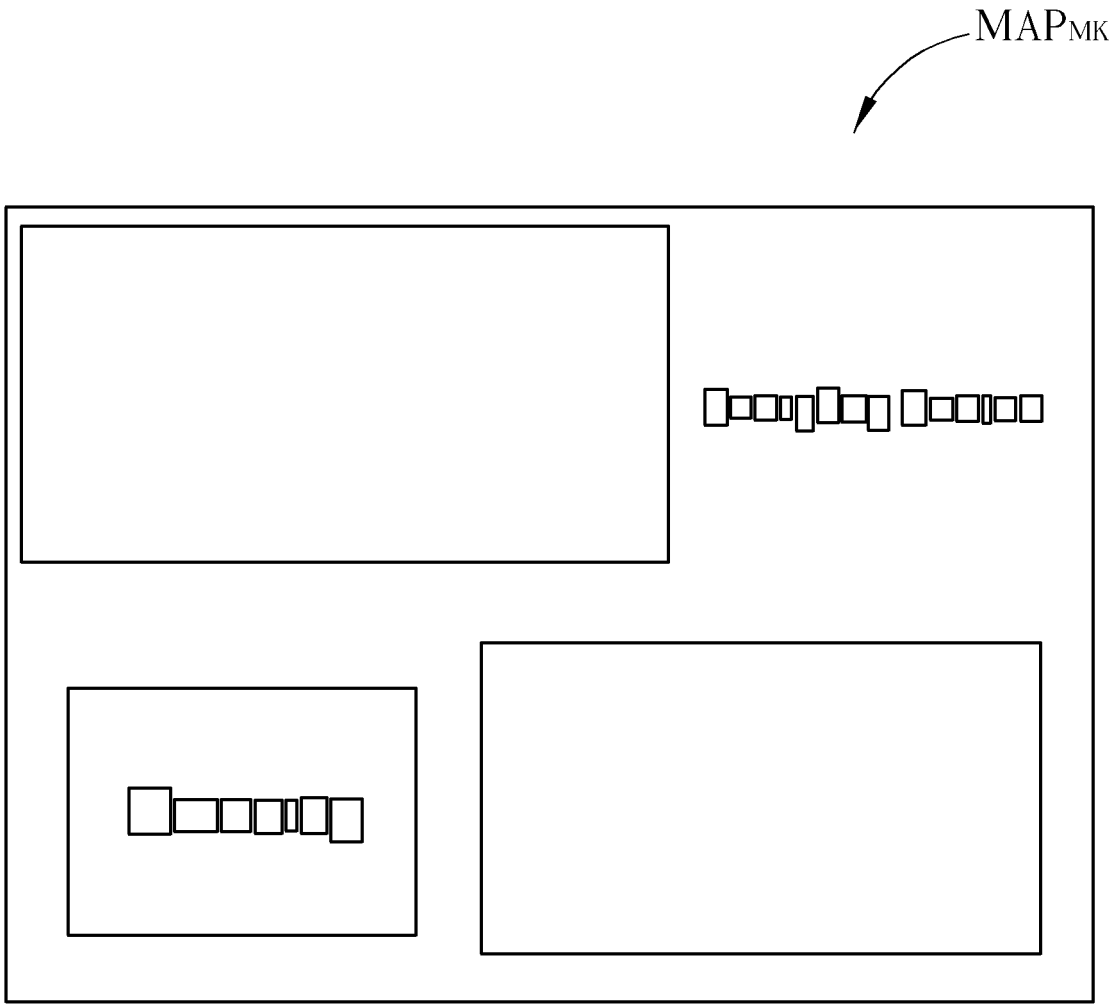
FIG. 11 is a diagram illustrating an example of a mask map generated by a mask generation unit shown in FIG. 4.

FIG. 11 is a diagram illustrating an example of a mask map generated by the mask generation unit 406 shown in FIG. 4. Assuming that the edge map $MAP_{EG}$ shown in FIG. 5 is generated from the edge extraction unit 402 and then processed by the following edge labeling unit 404 and mask generation unit 406, a mask map $MAP_{MK}$ corresponding to the edge map $MAP_{EG}$ can be obtained. Each rectangular area in the mask map $MAP_{MK}$ shown in FIG. 11 is a mask determined for one edge label. It should be noted that one mask may have one or more internal masks.

Figure 12:
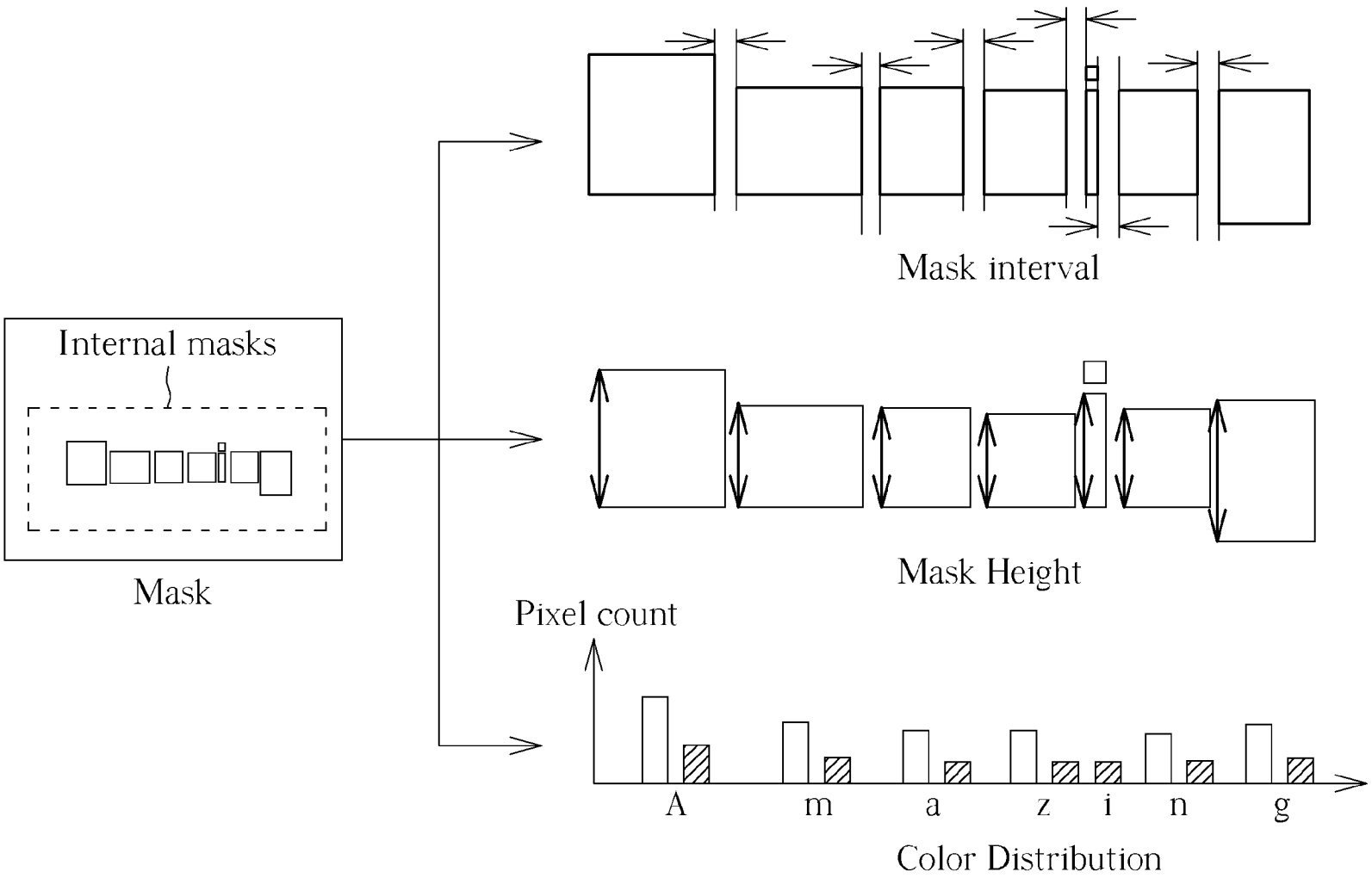
FIG. 12 is a diagram illustrating several characteristics possessed by internal masks of a mask according to an embodiment of the present invention.

The mask classification unit 408 analyzes masks in the mask map $MAP_{MK}$ to classify the contents of the input frame IMG_IN into text contents and non-text contents. For example, a mask with one or more internal masks is analyzed by the mask classification unit 408, such that the mask classification unit 408 can refer to an analysis result to decide if an image content corresponding to the mask is a text content. FIG. 12 is a diagram illustrating several characteristics possessed by internal masks of a mask according to an embodiment of the present invention. As can be known from FIG. 3, the bottom-left region has the text content "Amazing". Hence, these characters "A", "m", "a", "z", "i", "n", and "g" may cause internal masks. In general, the intervals of the characters "A", "m", "a", "z", "i", "n", and "g" are constrained within a specific range, and the heights of the characters "A", "m", "a", "z", "i", "n", and "g" are constrained within another specific range. Further, in most cases, the foreground colors of the characters "A", "m", "a", "z", "i", "n", and "g" are the same (e.g., black color), and the background colors of the characters "A", "m", "a", "z", "i", "n", and "g" are the same (e.g., white color). Based on above observations, the mask classification unit 408 can refer to mask intervals of the interval masks, mask heights of the interval masks, and color distributions (i.e., color histogram) of pixels in the input frame IMG_IN that correspond to the internal masks to determine if an image content corresponding to the mask with the internal masks is a text content.

Figure 13:
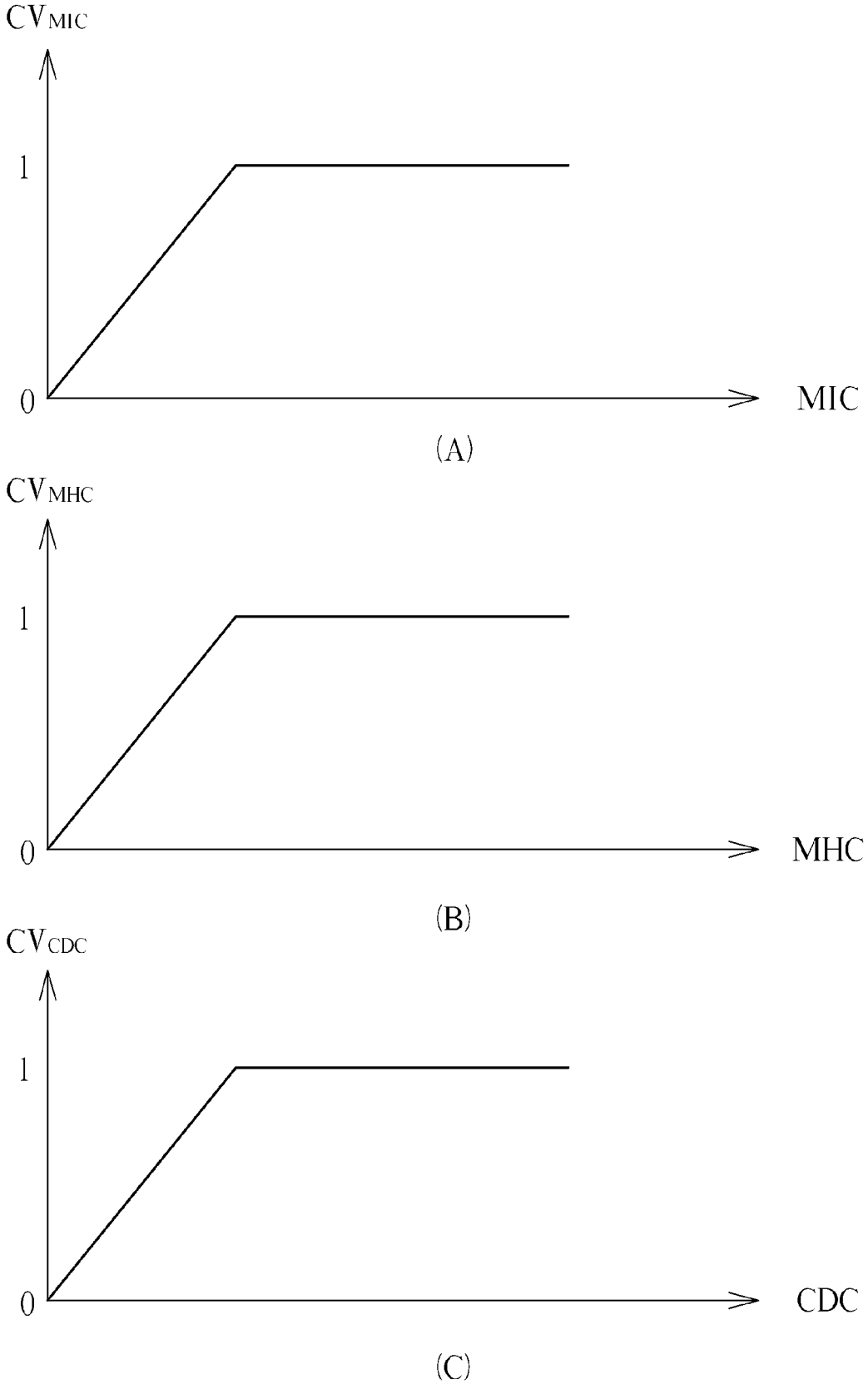
FIG. 13 is a diagram illustrating mapping functions used for determining a confidence value of mask interval consistency, a confidence value of mask height consistency, and a confidence value of color distribution consistency according to an embodiment of the present invention.

For example, the mask classification unit 408 may calculate a confidence value $CV_T$ of text for each mask with internal mask (s) based on the following formula:

$$CV_T = CV_{MIC} \times CV_{MHC} \times CV_{CDC} \quad (4)$$

where $CV_{MIC}$ represents a confidence value of mask interval consistency, $CV_{MHC}$ represents a confidence value of mask height consistency, and $CV_{CDC}$ represents a confidence value of color distribution consistency. The mask interval consistency may be determined based on variation of mask intervals of the interval masks. The mask height consistency may be determined based on variation of mask heights of the interval masks. The color distribution consistency may be determined based on variation of color distributions (i.e., color histogram) of pixels in the input frame IMG_IN that correspond to the internal masks. Further, the confidence value $CV_{MIC}$ may be evaluated using the mapping function shown in sub-diagram (A) of FIG. 13, the confidence value $CV_{MHC}$ may be evaluated using the mapping function shown in sub-diagram (B) of FIG. 13, and the confidence value $CV_{CDC}$ may be evaluated using the mapping function shown in sub-diagram (C) of FIG. 13.

It should be noted that using all of the confidence values $CV_{MIC}$, $CV_{MHC}$, and $CV_{CDC}$ to determine the confidence value $CV_T$ is for illustrative purposes only, and is not meant to be a limitation of the present invention. In one alternative design, the confidence value $CV_T$ may be obtained based on two of the confidence values $CV_{MIC}$, $CV_{MHC}$, and $CV_{CDC}$ only. In another alternative design, the confidence value $CV_T$ may be obtained based on one of the confidence values $CV_{MIC}$, $CV_{MHC}$, and $CV_{CDC}$ only. Further, the mapping functions shown in FIG. 13 may be adjusted, depending upon actual design consideration.

A larger confidence value $CV_T$ means it is more possible that this mask corresponds a text content. In this embodiment, the mask classification unit 408 may compare the confidence value $CV_T$ with a predetermined threshold $TH_3$ for content classification. For example, the mask classification unit 408 classifies an image content corresponding to a mask as a text content when the confidence value $CV_T$ associated with the mask is larger than $TH_3$, and classifies the image content corresponding to the mask as a non-text content when the confidence value $CV_T$ associated with the mask is not larger than $TH_3$. Further, in one exemplary design, no classification is performed for masks with too small sizes.

The display adjustment circuit 106 shown in FIG. 1 is configured to generate an output frame IMG_OUT to the display device 10 by performing image content adjustment according to the viewing condition recognition result VC_R and the content classification result CC_R. For example, the image content adjustment includes at least content-adaptive adjustment applied to at least a portion (i.e., part or all) of pixel positions of the input frame IMG_IN based on the content classification result CC_R, and the image content adjustment is activated when the information (e.g., confidence value $CV_{UV}$) derived from the viewing condition recognition result VC_R is larger than the predetermined threshold $TH_1$.

Figure 14:
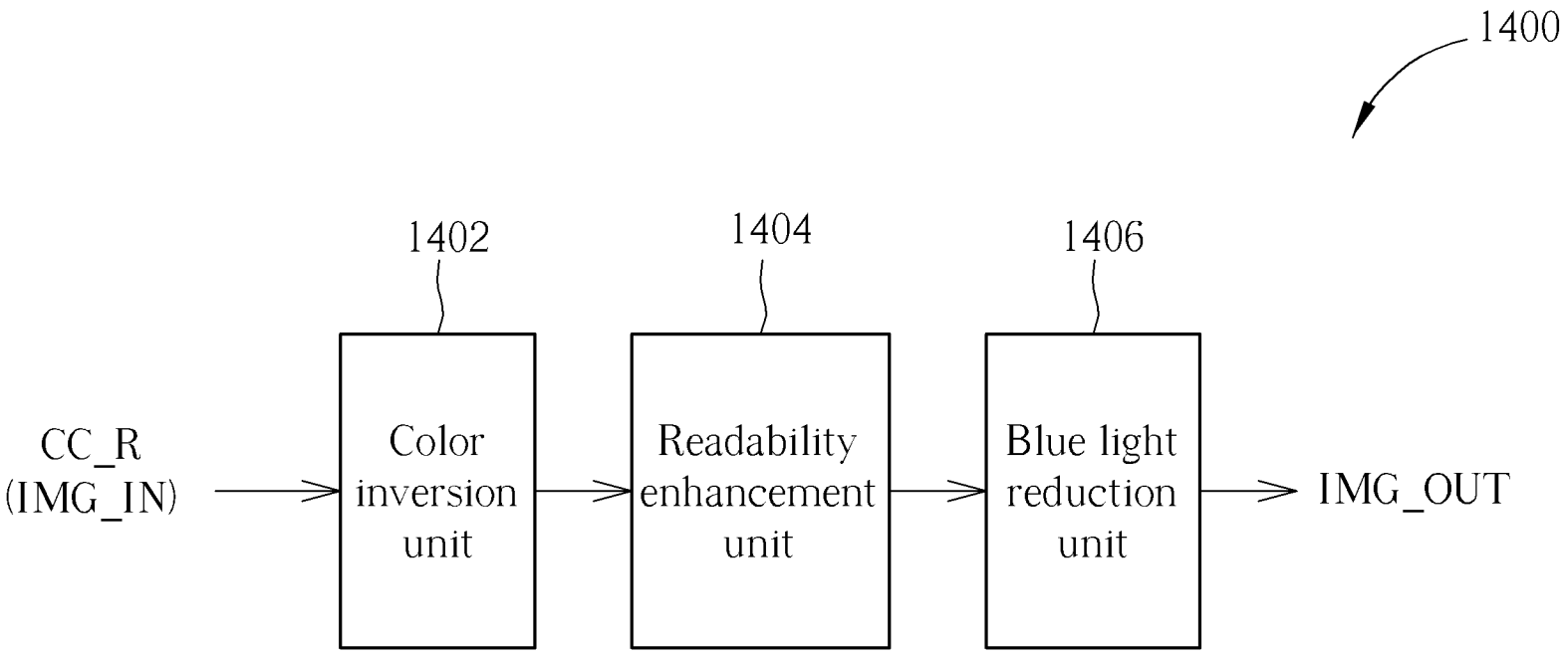
FIG. 14 is a block diagram illustrating a content adjustment block according to an embodiment of the present invention.

In this embodiment, the content adjustment block 107 is responsible for performing the image content adjustment upon contents of the input frame IMG_IN, especially text contents and non-text contents indicated by the content classification result CC_R. FIG. 14 is a block diagram illustrating a content adjustment block according to an embodiment of the present invention. The content adjustment block 107 shown in FIG. 1 may be implemented using the content adjustment block 1400 shown in FIG. 14. In this embodiment, the content adjustment block 1400 includes a color histogram adjustment unit (e.g., a color inversion unit 1402), a readability enhancement unit 1404, and a blue light reduction unit 1406.

The color histogram adjustment unit (e.g., color inversion unit 1402) is configured to apply color histogram adjustment to at least one text content indicated by the content classification result CC_R. Taking a specific value for example, the original number of pixels with the specific pixel value may be equal to a first value before the color histogram adjustment is performed, and the new number of pixels with the specific pixel value may be equal to a second value different from the first value after the color histogram adjustment is performed. For example, when the viewing condition becomes worse, the color histogram adjustment is capable of changing text colors displayed on the display device 10 according to eye physiology, thereby achieving the eye protection needed. In one exemplary design, the color histogram adjustment may be implemented using color inversion. The color inversion may be applied to at least one color channel. For example, the color inversion may be applied to all color channels.

Figure 15:
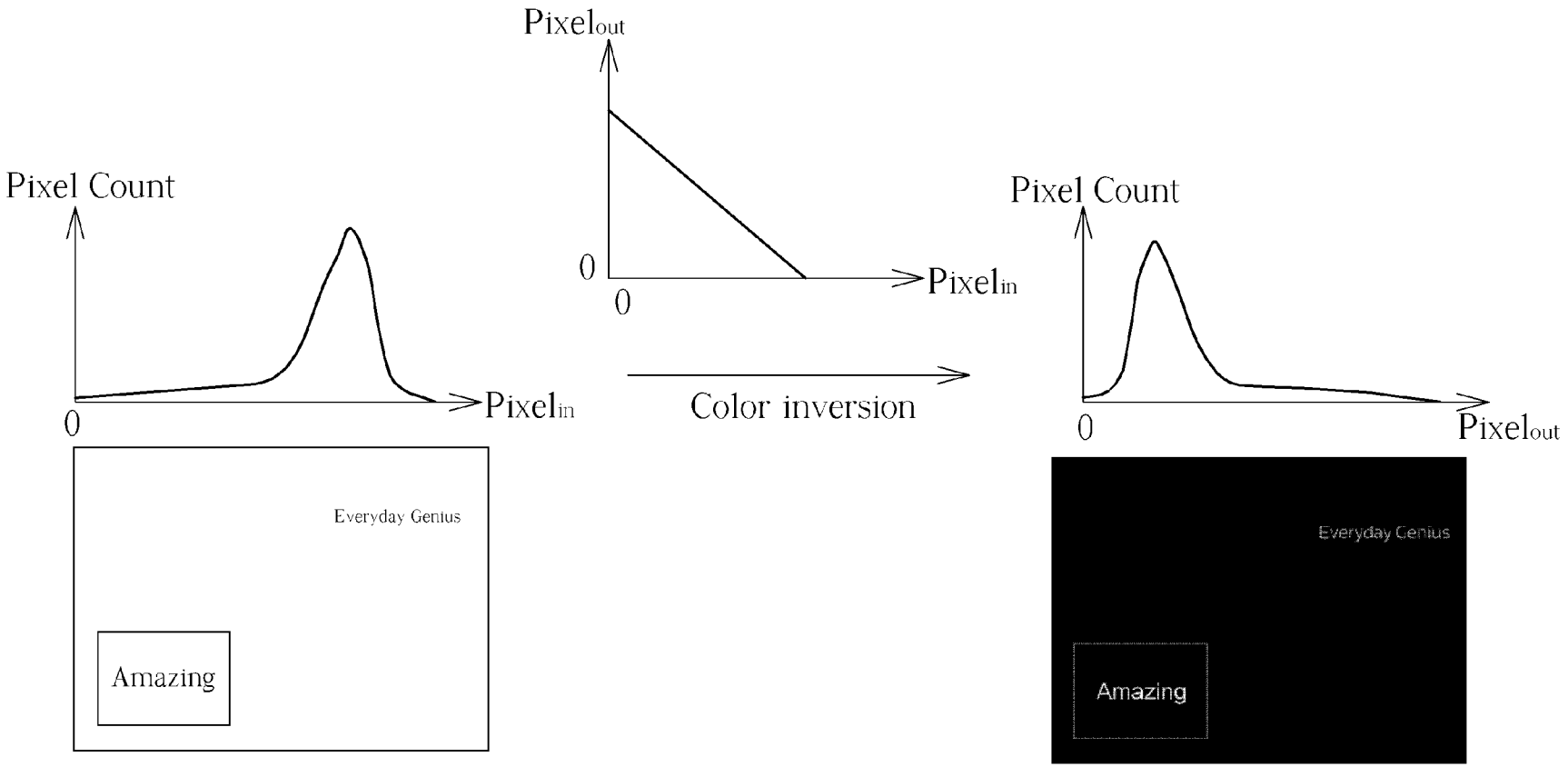
FIG. 15 is a diagram illustrating color inversion performed by a color inversion unit shown in FIG. 14.

In a case where the color histogram adjustment unit is implemented using the color inversion unit 1402, the color inversion unit 1402 may be configured to apply color inversion to dark text with bright background only. FIG. 15 is a diagram illustrating color inversion performed by the color inversion unit 1402 shown in FIG. 14. Concerning the original text contents "Amazing" and "Everyday Genius" shown in FIG. 15, most of the pixels have white color due to bright background. Hence, the pixel count of pixels with a smaller pixel value $Pixel_{in}$ (e.g., (R, G, B)=(0, 0, 0)) is smaller than the pixel count of pixels with a larger pixel value $Pixel_{in}$ (e.g., (R, G, B)=(255, 255, 255)). The color inversion is used to invert pixel values $Pixel_{in}$ of input pixels. In this way, an input pixel with a larger pixel value $Pixel_{in}$ (e.g., (R,G,B)=(255, 255, 255)) will become an output pixel with a smaller pixel value $Pixel_{out}$ (e.g., (R, G, B)=(0, 0, 0)), and an input pixel with a smaller pixel value $Pixel_{in}$ (e.g., (R, G, B)=(0, 0, 0)) will become an output pixel with a larger pixel value $Pixel_{out}$ (e.g., (R, G, B)=(255, 255, 255)). Concerning the color-inverted text contents shown in FIG. 15, most of the pixels have black color due to dark background. Hence, the pixel count of pixels with a smaller pixel value $Pixel_{out}$ (e.g., (R, G, B)=(0, 0, 0)) is larger than the pixel count of pixels with a larger pixel value $Pixel_{out}$ (e.g., (R, G, B)=(255, 255, 255)). When the viewing condition becomes worse, displaying the color-inverted text contents (e.g., bright text with dark background) on the display device 10 can make user's eyes feel more comfortable.

The readability enhancement unit 1404 is configured to apply readability enhancement to at least a portion (i.e., part or all) of the pixel positions of the input frame IMG_IN. For example, the readability enhancement may include contrast adjustment to make the readability better. Since the content classification circuit 104 is capable of separating contents of the input frame IMG_IN into text contents and non-text contents, the readability enhancement unit 1404 may be configured to perform content-adaptive readability enhancement according to the content classification result CC_R. In a first exemplary design, the readability enhancement (e.g., contrast adjustment) may be applied to text contents and non-text contents. In a second exemplary design, the readability enhancement (e.g., contrast adjustment) may be applied to text contents only. In a third exemplary design, the readability enhancement (e.g., contrast adjustment) may be applied to non-text contents only.

Figure 16:
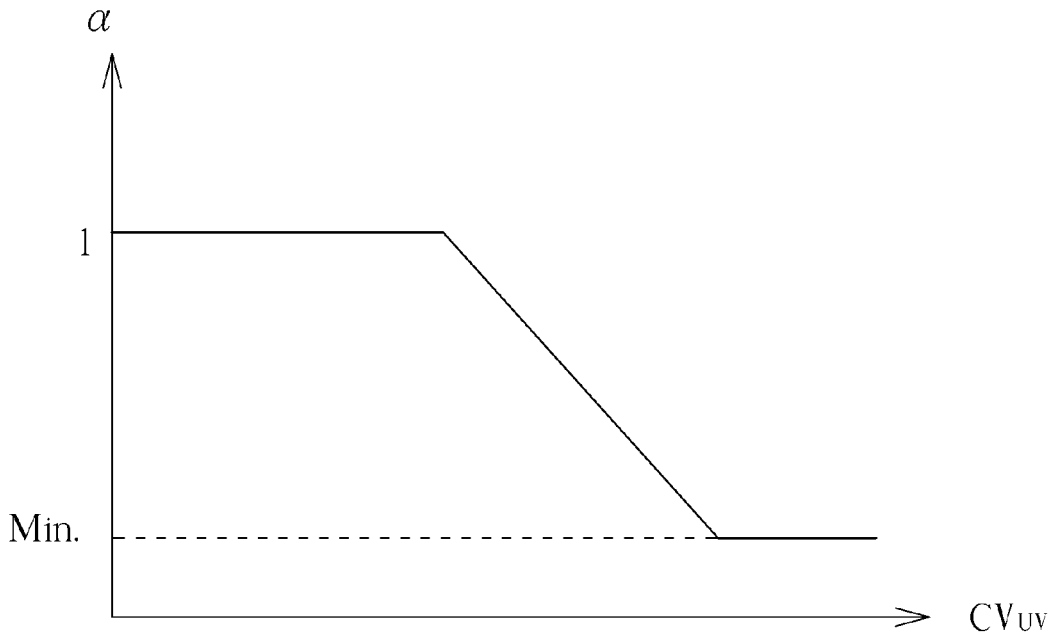
FIG. 16 is a diagram illustrating a mapping function used for determining a reduction coefficient of blue light reduction according to an embodiment of the present invention.

The blue light reduction unit 1406 is configured to apply blue light reduction to at least a portion (i.e., part or all) of the pixel positions of the input frame IMG_IN. For example, the blue light reduction for one pixel may be expressed by following formula:

$$\begin{bmatrix} R_{out} \\ G_{out} \\ B_{out} \end{bmatrix} = \begin{bmatrix} 1 & 0 & 0 \\ 0 & 1 & 0 \\ 0 & 0 & \alpha \end{bmatrix} \begin{bmatrix} R_{in} \\ G_{in} \\ B_{in} \end{bmatrix} \quad (5)$$

where ($R_{in}$, $G_{in}$, $B_{in}$) represents the pixel value of an input pixel fed into the blue light reduction unit 1406, ($R_{out}$, $G_{out}$, $B_{out}$) represents the pixel value of an output pixel generated from the blue light reduction unit 1406, and a represents a reduction coefficient. The same reduction coefficient α may be applied to the blue color component of each pixel processed by the blue light reduction unit 1406. The reduction coefficient α may be decided based on the viewing condition (e.g., confidence value $CV_{UV}$). For example, the reduction coefficient α may be decided using the mapping function shown in FIG. 16.

Since the content classification circuit 104 is capable of separating contents of the input frame IMG_IN into text contents and non-text contents, the blue light reduction unit 1406 may be configured to perform content-adaptive blue light reduction according to the content classification result CC_R. In a first exemplary design, the blue light reduction may be applied to text contents and non-text contents. In a second exemplary design, the blue light reduction may be applied to text contents only. In a third exemplary design, the blue light reduction may be applied to non-text contents only.

In accordance with the formula (5) mentioned, the blue channel component of a pixel value is adjusted by the reduction coefficient α, while the red color channel and the green color channel of the pixel value are kept unchanged. However, this is for illustrative purposes only, and is not meant to be a limitation of the present invention. In an alternative design, when the reduction coefficient α is set by a value larger than a predetermined threshold, the blue light reduction unit 1406 may further apply one adjustment coefficient to the red color component, and/or may further apply one adjustment coefficient to the green color component. In this way, the display quality will not be significantly degraded by the blue light reduction using a large reduction coefficient α.

As shown in FIG. 14, the color histogram adjustment unit (e.g., color inversion unit 1402), the readability enhancement unit 1404, and the blue light reduction unit 1406 are jointly used to apply image content adjustment to the input frame IMG_IN for generating the output frame IMG_OUT. However, this is for illustrative purposes only, and is not meant to be a limitation of the present invention. In an alternative design, the content adjustment block 107 may be modified to include (or activate) one or two of the color histogram adjustment unit (e.g., color inversion unit 1402), the readability enhancement unit 1404, and the blue light reduction unit 1406. For example, the content adjustment block 107 may be configured to jointly use the color histogram adjustment unit (e.g., color inversion unit 1402) and the readability enhancement unit 1404 to apply image content adjustment to the input frame IMG_IN. For another example, the content adjustment block 107 may be configured to jointly use the color histogram adjustment unit (e.g., color inversion unit 1402) and the blue light reduction unit 1406 to apply image content adjustment to the input frame IMG_IN. For yet another example, the content adjustment block 107 may be configured to solely use the color histogram adjustment unit (e.g., color inversion unit 1402) to apply image content adjustment to the input frame IMG_IN. These alternative designs all fall within the scope of the present invention.

Assume that the display device 10 is a liquid crystal display (LCD) device using a backlight module (not shown). The display adjustment circuit 106 may further include the backlight adjustment block 108 configured to perform backlight adjustment according to information (e.g., sensor output S1) derived from the viewing condition recognition result VC_R. In one exemplary design, the backlight adjustment block 108 may decide a backlight control signal $S_{BL}$ of the backlight module based on the ambient light intensity indicated by the sensor output S1, where the backlight control signal $S_{BL}$ is transmitted to the backlight module of the display device 10 to set the backlight intensity.

Figure 17:
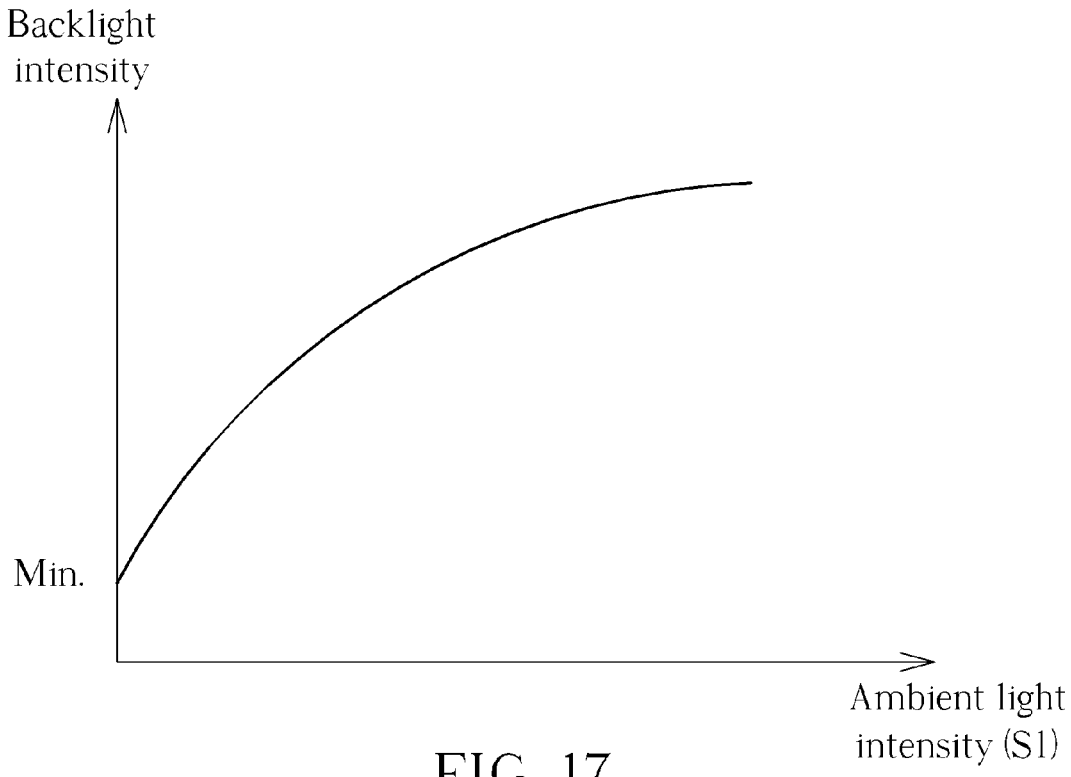
FIG. 17 is a diagram illustrating the backlight adjustment performed by a backlight adjustment block shown in FIG. 1.

FIG. 17 is a diagram illustrating the backlight adjustment performed by the backlight adjustment block 108 shown in FIG. 1. In this example, the darker is the viewing condition, the backlight intensity is lower. When the viewing condition is worse due to lower ambient light intensity, pupils of user's eyes will be dilated. The backlight adjustment block 108 is capable of reducing the backlight intensity, thus protecting user's eyes from being damaged by a high-brightness display output.

It should be noted that the backlight adjustment block 108 may be an optional component. For example, in a case where the display device 10 uses no backlight module, the backlight adjustment block 108 may be omitted.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display control apparatus, comprising:

a viewing condition recognition circuit, wherein the viewing condition recognition circuit generates a viewing condition recognition result by recognizing a viewing condition associated with a display device and based on a confidence value of uncomfortable viewing that is calculated using a mathematical combination of a confidence value of low light and a confidence value of short distance, the viewing condition recognition circuit calculating the confidence value of low light according to output of an ambient light sensor and calculating the confidence value of short distance according to output of a proximity sensor;

a content classification circuit, wherein the content classification circuit generates a content classification result of contents included in an input frame by analyzing the input frame; and a display adjustment circuit, wherein the display adjustment circuit generates an output frame by performing image content adjustment according to the viewing condition recognition result and the content classification result, and outputs the output frame to the display device which displays the output frame; and the image content adjustment comprises at least content-adaptive adjustment applied to at least a portion of the contents of the input frame, and said at least a portion of the contents is selected based on the content classification result.

2. The display control apparatus of claim 1, wherein the content classification circuit generates an edge map of the input frame by extracting edge information from the input frame, and generates the content classification result according to the edge map.

3. The display control apparatus of claim 1, wherein the content classification circuit generates the content classification result by classifying the contents included in the input frame into text and non-text.

4. The display control apparatus of claim 1, wherein the display adjustment circuit controls activation of at least the image content adjustment by comparing information derived from the viewing condition recognition result with a predetermined threshold.

5. The display control apparatus of claim 1, wherein the content-adaptive adjustment comprises color histogram adjustment applied to at least one text content indicated by the content classification result.

6. The display control apparatus of claim 5, wherein the color histogram adjustment includes color inversion.

7. The display control apparatus of claim 1, wherein the image content adjustment further comprises readability enhancement applied to at least a portion of the input frame.

8. The display control apparatus of claim 7, wherein the readability enhancement includes contrast adjustment.

9. The display control apparatus of claim 1, wherein the image content adjustment further comprises blue light reduction applied to at least a portion of the input frame.

10. The display control apparatus of claim 1, wherein the display adjustment circuit further performs backlight adjustment according to information derived from the viewing condition recognition result.

11. A display control method, comprising:

receiving output from an ambient light sensor and from a proximity sensor;

generating a viewing condition recognition result by recognizing a viewing condition associated with a display device and based on a confidence value of uncomfortable viewing that is calculated using a mathematical combination of a confidence value of low light and a confidence value of short distance, the viewing condition recognition circuit calculating the confidence value of low light according to output of an ambient light sensor and calculating the confidence value of short distance according to output of a proximity sensor;

generating a content classification result of contents included in an input frame by analyzing the input frame; and generating an output frame by performing image content adjustment, via a display adjustment circuit, according to the viewing condition recognition result and the content classification result, and outputting the output frame to the display device which displays the output frame, wherein the image content adjustment comprises at least content-adaptive adjustment applied to at least a portion of the contents of the input frame, and said at least a portion of the contents is selected based on the content classification result.

12. The display control method of claim 11, wherein generating the content classification result of the contents included in the input frame by analyzing the input frame comprises:

generating an edge map of the input frame by extracting edge information from the input frame; and generating the content classification result according to the edge map.

13. The display control method of claim 11, wherein generating the content classification result of the contents included in the input frame by analyzing the input frame comprises:

generating the content classification result by classifying the contents included in the input frame into text and non-text.

14. The display control method of claim 11, wherein performing the image content adjustment, via the display adjustment circuit, according to the viewing condition recognition result and the content classification result comprises:

controlling activation of at least the image content adjustment by comparing information derived from the viewing condition recognition result with a predetermined threshold.

15. The display control method of claim 11, wherein the content-adaptive adjustment comprises color histogram adjustment applied to at least one text content indicated by the content classification result.

16. The display control method of claim 15, wherein the color histogram adjustment includes color inversion.

17. The display control method of claim 11, wherein the image content adjustment further comprises readability enhancement applied to at least a portion of the input frame.

18. The display control method of claim 17, wherein the readability enhancement includes contrast adjustment.

19. The display control method of claim 11, wherein the image content adjustment further comprises blue light reduction applied to at least a portion of the input frame.

20. The display control method of claim 11, further comprising:

performing backlight adjustment according to information derived from the viewing condition recognition result.

21. The display control apparatus of claim 1, wherein the confidence value of uncomfortable viewing is calculated by multiplying the confidence value of low light by the confidence value of short distance.

22. The display control method of claim 11, wherein the confidence value of uncomfortable viewing is calculated by multiplying the confidence value of low light by the confidence value of short distance.

* * * * *